US007458772B2

(12) United States Patent
Benedetti et al.

(10) Patent No.: US 7,458,772 B2
(45) Date of Patent: Dec. 2, 2008

(54) GUIDE VANE RING OF A TURBOMACHINE AND ASSOCIATED MODIFICATION METHOD

(75) Inventors: Bruno Benedetti, Graenichen (CH); Andreas Boegli, Vogelsang (CH); Christopher Hulme, Wuerenlingen (CH); James Ritchie, Ennetbaden (CH); Patrick Wolfgang Schnedler, Wettingen (CH)

(73) Assignee: ALSTOM Technology Ltd., Baden (CH)

( * ) Notice: Subject to any disclaimer, the term of this patent is extended or adjusted under 35 U.S.C. 154(b) by 518 days.

(21) Appl. No.: 11/255,988

(22) Filed: Oct. 24, 2005

(65) Prior Publication Data

US 2006/0251519 A1 Nov. 9, 2006

(51) Int. Cl.
*F01D 25/28* (2006.01)

(52) U.S. Cl. ..... 415/173.1; 415/209.3

(58) Field of Classification Search ..... 415/173.1, 415/209.2, 209.3

See application file for complete search history.

(56) References Cited

U.S. PATENT DOCUMENTS 5,641,267 A * 6/1997 Proctor et al. ..... 415/173.1

FOREIGN PATENT DOCUMENTS

DE 1476928 7/1969
DE 10210866 8/2003
EP 1039096 9/2000

OTHER PUBLICATIONS

Search Report for European Patent App. No. 05109944, dated Mar. 10, 2006.

* cited by examiner

*Primary Examiner*—Richard Edgar
(74) *Attorney, Agent, or Firm*—Cermak Kenealy & Vaidya LLP; Adam J. Cermak

(57) ABSTRACT

A guide vane ring of a turbomachine, in particular of an axial-throughflow turbine, includes a vane group (6) having a plurality of vanes (2). The vane group (6) has a vane root (11) which has two flanges (12, 13). The vane group (6) is fastened to a vane carrier by means of the flanges (12, 13). In order to reduce stresses in the vanes (2) which occur during deformations of the vane carrier, one flange (13) has on a front end portion (14) and on a rear end portion (15), radially on the inside and radially on the outside, in each case a contact zone (18) which bears against the vane carrier. The other flange (12) has on one end portion (15), radially on the inside, a contact zone (18) which bears against the vane carrier, and is spaced apart from the vane carrier radially on the outside. Moreover, this flange (12) has on the other end portion (14), radially on the outside, a contact zone (18) which bears against the vane carrier, and is spaced apart from the vane carrier radially on the inside. Furthermore, the flanges (12, 13), between their end portions (14, 15), are spaced apart from the vane carrier radially on the inside and radially on the outside.

10 Claims, 6 Drawing Sheets

GUIDE VANE RING OF A TURBOMACHINE AND ASSOCIATED MODIFICATION METHOD

This application claims priority under 35 U.S.C. § 119 to Swiss patent application number 01769/04, filed 26 Oct. 2004, the entirety of which is incorporated by reference herein.

BACKGROUND OF THE INVENTION

1. Field of the Invention

The present invention relates to a guide vane ring of a turbomachine, in particular of an axial-throughflow turbine or a compressor, in particular of a gas turbine. The invention relates, moreover, to a method of a modification of a guide vane ring of this type.

2. Brief Description of the Related Art

A guide vane ring conventionally consists of a plurality of vanes which are arranged next to one another in the circumferential direction and in this case are fastened to an annular vane carrier individually or in groups comprising a plurality of vanes. This vane carrier, which conventionally consists of two semiannular or semicircular parts, is itself fastened to a casing of the turbomachine. Conventionally, the vane carrier for the guide vane ring possesses an inflow-side inlet groove and an outflow-side outlet groove. These grooves in this case extend in the circumferential direction. The vanes or vane groups have in each case a vane root which has an inflow-side inlet flange and an outflow-side outlet flange. The flanges, too, extend in the circumferential direction and in this case project axially from the respective vane root. In the mounted state, the inlet flanges engage into the inlet groove and the outlet flanges into the outlet groove. The terms "inflow-side" and "outflow-side" relate to the flow direction in the region of the guide vane ring which prevails when the turbomachine is in operation.

Where large vanes and, in particular, large vane groups are concerned, it is customary for the flanges to be supported on the vane carrier in the region of the respective groove both radially on the inside and radially on the outside. A particularly intensive fastening of the vanes on the vane carrier can thereby be achieved, this also being required in order to support the high flow forces or pressure differences which may occur when the turbomachine is in operation. Precisely where large vanes are concerned, the vane carriers are also very large components which are exposed to different thermal loads when the turbomachine is in operation. On the one hand, when the turbomachine is in operation, particularly in the case of a turbine, there are pronounced temperature differences between a cooling gas and a hot gas. On the other hand, pronounced temperature differences arise even in hot gas when the latter expands during its passage through the respective turbine stage. The thermal loads vary during transient operating states, that is to say, for example, when the turbomachine is being run up and when it is being shut down. Varying thermal loads on the vane carrier may deform this. In this case, a kind of ovalization is regularly to be observed, in which the two vane carrier halves which butt against one another at their circumferential ends in a parting plane widen along the parting plane, so that the radii of the vane carrier parts increase at circumferential ends bearing against one another or contract in the region of the parting plane, with the result that the radii of the vane carrier parts having circumferential ends bearing against one another are reduced. At the same time, this may give rise to distortion within the vane carrier.

Moreover, greater deformations regularly occur at the lower vane carrier part than at the upper vane carrier part which is conventionally incorporated considerably more efficiently into the casing of the turbomachine. Said deformations of the vane carrier are transferred via the grooves to the flanges and therefore via the vane roots into the vanes or into the vane groups, with the result that these, too, are exposed to high stresses. Furthermore, the vanes may be supported against one another in the circumferential direction, radially on the inside, via shrouds, thus generating additional stresses in these when the vanes change their position as result of deformation of the vane carrier.

Said distortions may cause cracks and reduce the useful life of the vanes. In the worst case, a failure of the turbomachine may occur.

SUMMARY OF THE INVENTION

The invention is intended to remedy this. The invention is concerned with the problem of indicating, for a guide vane ring of the type initially mentioned, a possibility which reduces the risk of crack formation on the vanes.

One aspect of the present invention includes the general idea of designing the fastening of vanes or vane groups on the vane carrier in such a way that these can absorb a dimensional change in the vane carrier, without particularly high stresses occurring in this case in the vane. This is achieved in that, within the tie-up between vane root and vane carrier, degrees of freedom are provided in a controlled way, which permit deformations of the vane carrier typically occurring in the case of thermal loads on the vane carrier, so that such a deformation of the vane carrier leads to no distortion, or only to reduced distortion, in the vane root and therefore in the respective vane or vane group.

For this purpose, the invention proposes, in the case of one flange, for example the inlet flange, to provide both on a front end portion in the circumferential direction and on a rear end portion in the circumferential direction, both radially on the inside and radially on the outside, in each case a contact zone which bears against the vane carrier. In contrast to this, on the other flange, that is to say, for example, on the outlet flange, on one end portion, for example on the front end portion, radially on the inside, a contact zone is provided which bears against the vane carrier, whereas this end portion is spaced apart from the vane carrier radially on the outside. On the other end portion in each case, that is to say, for example, on the rear end portion, radially on the outside, a contact zone which bears against the vane carrier is then again provided, whereas this end portion is then spaced apart from the vane carrier radially on the inside. Thus, in the case of one of the flanges, that is to say, here, for example, on the outflow-side outlet flange, the contact zones are arranged diametrically opposite with respect to the end portions or the end portions are positioned, diametrically opposite, so as to be spaced apart from the vane carrier. This results, in each end portion of the vane root, in a degree of freedom which permits a change in radius of the vane carrier and a distortion of the vane carrier. At the same time, it is proposed that the flanges, between their end portions, be spaced apart from the vane carrier both radially on the inside and radially on the outside. Thus, the contact zones of the front end portion are at as great a distance as possible from the contact zones of the rear end portion, with the result that a particularly high elasticity is provided in the vane root. Correspondingly, in the region of its flanges, the vane root can also elastically absorb relatively pronounced dimensional changes of the vane carrier, so that critical loads and distortions of the vane root and therefore of the vanes or vane groups can be avoided or reduced.

According to a particularly advantageous embodiment, the spacings, arranged diametrically with respect to the end portions, between the flange and the vane carrier may be dimensioned such that, when the turbomachine is operating normally, a pressure difference prevailing between the inflow side and outflow side reduces the spacing owing to the elastic flexural deformation of the vane or vane group and/or of the vane carrier and brings the corresponding end portion to bear against the vane carrier. In other words, during normal operation, the respective vane root is supported on the vane carrier at both end portions and at both flanges both radially on the inside and radially on the outside, thus resulting in a particularly intensive fixing of the vane or vane group on the vane carrier. In transient operating states, that is to say in those in which reduced pressure differences prevail between the inflow side and outflow side and the deformations of the vane carrier mainly take place, the desired spacings between vane root and vane carrier at the one flange can then form diametrically with respect to the end portions. Correspondingly, the vane root can then follow more closely the changing geometry of the vane carrier, thus reducing the load on the vanes.

Further important features and advantages of the present invention may be gathered from the drawings and from the associated figure description with reference to the drawings.

BRIEF DESCRIPTION OF THE DRAWINGS

Preferred exemplary embodiments of the invention are illustrated in the drawings and are explained in more detail in the following description, the same reference symbols relating to identical or similar or functionally identical components. In the drawings, in each case diagrammatically.

DETAILED DESCRIPTION OF EXEMPLARY EMBODIMENTS

Figure 1:
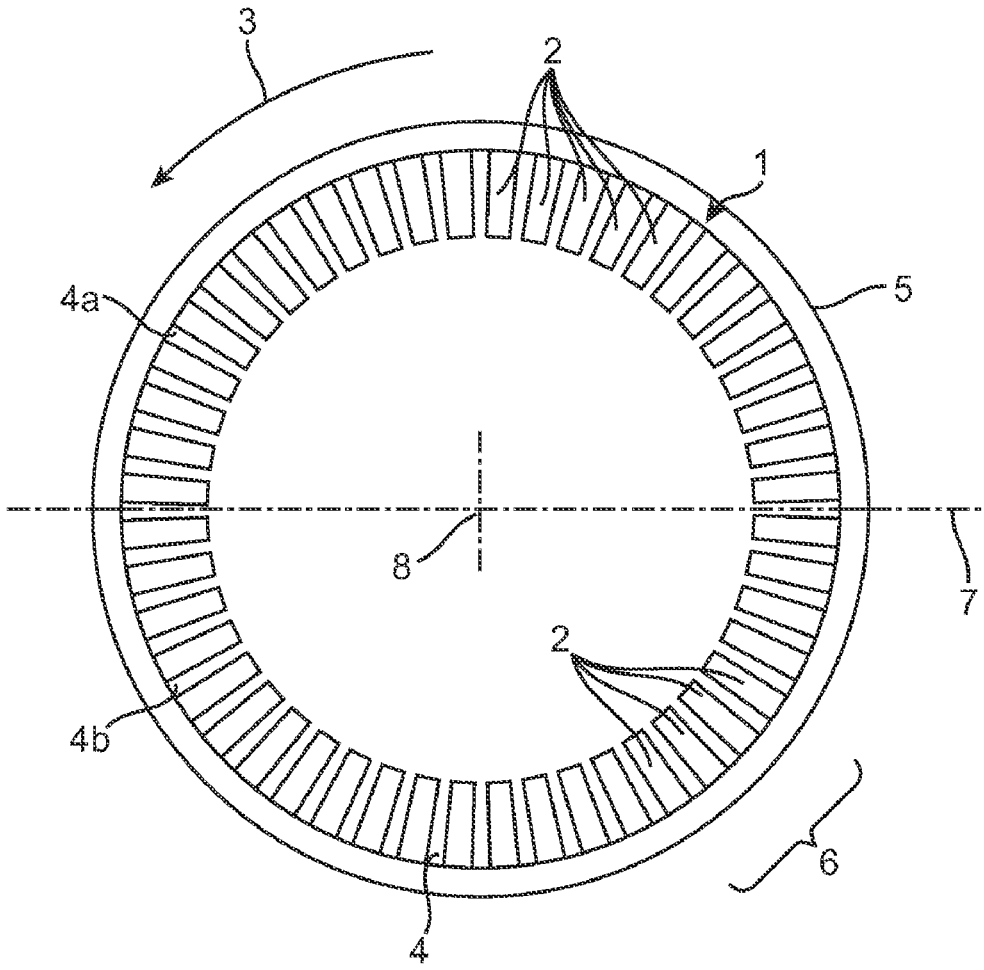
FIG. 1 shows a greatly simplified cross section through a turbomachine in the region of a guide vane ring.

According to FIG. 1, a guide vane ring 1 of a turbomachine, not otherwise illustrated, preferably of a turbine or compressor, preferably of a gas turbine, possesses a plurality of guide vanes or, in brief, vanes 2 which are arranged adjacently to one another in the circumferential direction 3. The vanes 2 are fastened on a vane carrier 4 which is itself fastened to a casing 5 of the turbomachine.

In this case, the vanes 2 may be fastened individually to the vane carrier 4 or be combined into vane groups 6 which are formed from two or more vanes 2 and are jointly fastened on the vane carrier 4. The vane carrier 4 is in this case of annular design and is expediently divided in the region of a parting plane 7 in which preferably an axis of rotation 8 or longitudinal center axis 8 of the turbomachine also lies, so that, according to FIG. 1, there are an upper vane carrier part 4*a* and a lower vane carrier part 4*b*. It is clear that a vane carrier 4 of this type may basically also serve for fastening the vanes 2 of a plurality of guide vane rings 1 which are adjacent in the axial direction.

Figure 5:
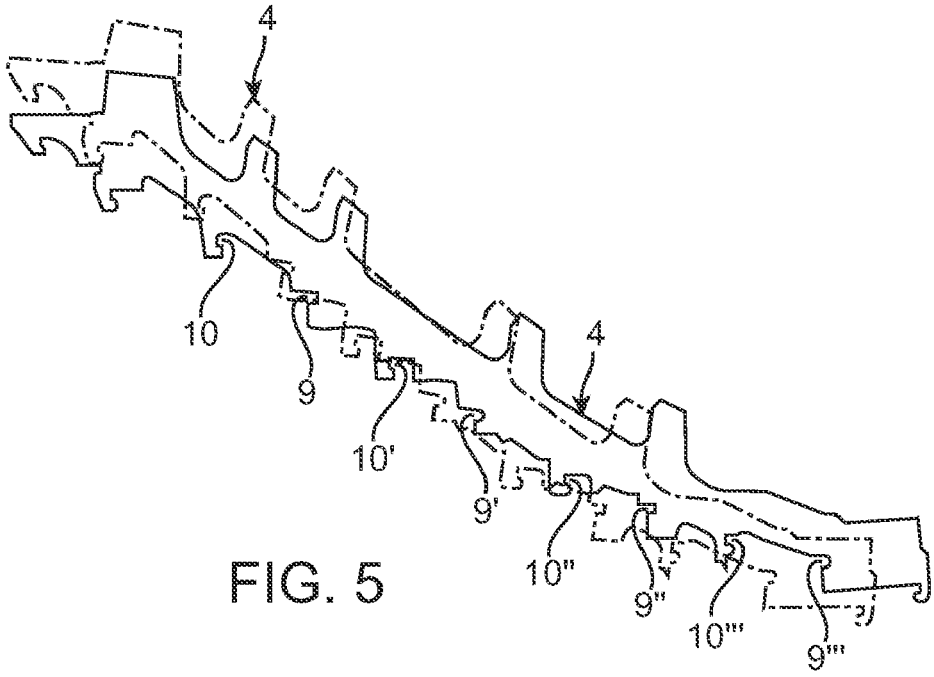
FIG. 5 shows an axial section through a vane carrier in different deformation states.

For example, FIG. 5 shows a longitudinal section through a vane carrier 4, in which the vanes 2 of a plurality of guide vane rings 1, that is to say of a plurality of turbine stages or compressor stages, can be fastened. For each guide vane ring 1, the vane carrier 4 possesses an inflow-side inlet groove 9 and an outflow-side outlet groove 10. In this case, in FIG. 5, the grooves 9 and 10 of different guide vane rings 1 are identified in the reference symbols by apostrophes. The two grooves 9 and 10, for each guide vane ring 1, in this case each extend in the circumferential direction 3 and at the same time run around in the form of a closed ring.

Figure 2:
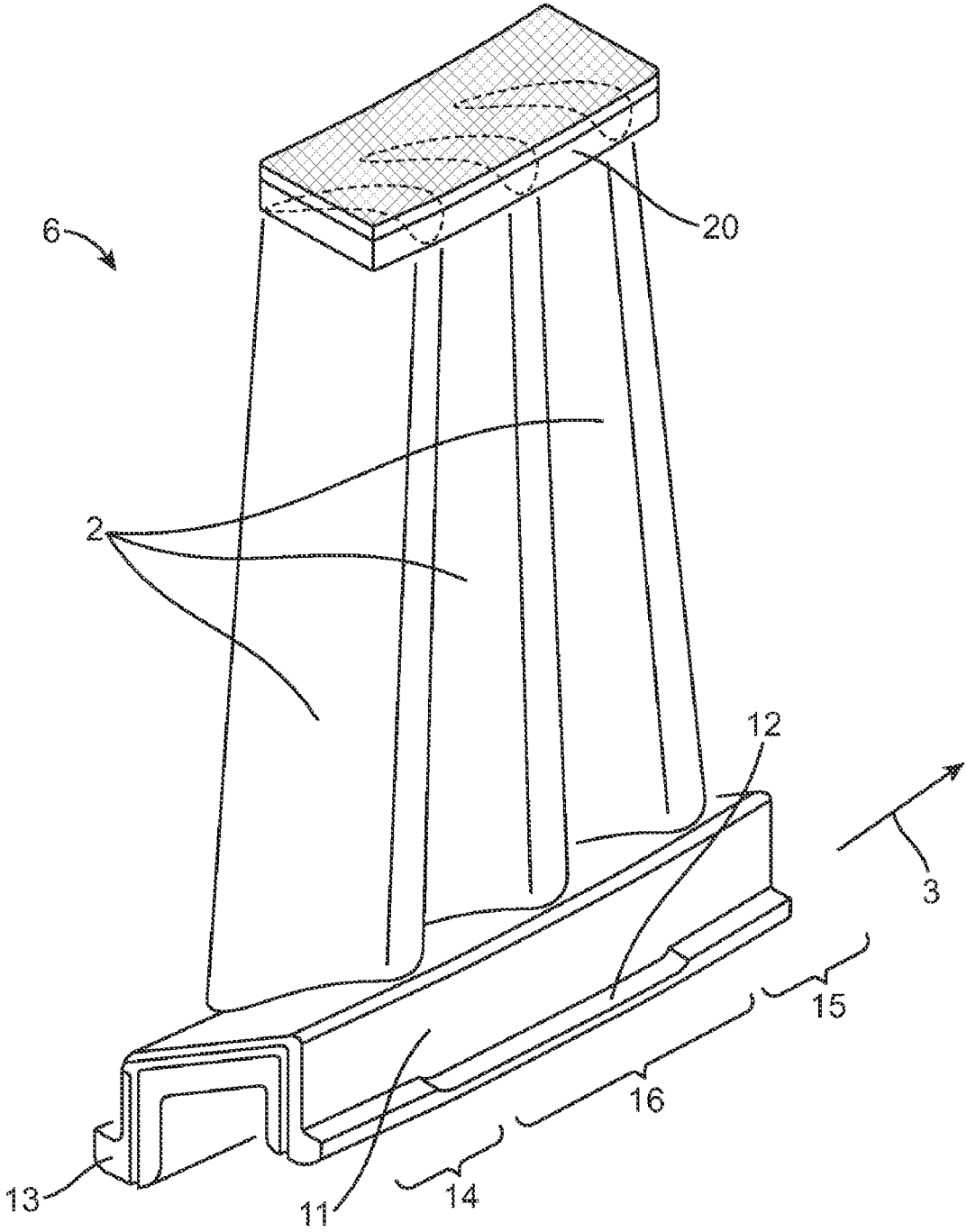
FIG. 2 shows a perspective view of a vane group.

Referring to FIG. 2, a vane group 6 includes, for example, three vanes 2 which have a common vane root 11 which is at the same time the vane root 11 of the vane group 6. The following explanations regarding the vane root 11 of the vane group 6 also apply correspondingly to a vane root 11 of an individual vane 2.

The vane root 11 has formed on it an inflow-side inlet flange 12 which extends in the circumferential direction 3 and which in this case projects axially from the vane root 11. Correspondingly, the vane root 11 also possesses an outflow-side outlet flange 13 which likewise extends in the circumferential direction 3 and which in this case projects axially from the vane root 11. At the same time, the flanges 12 and 13 in each case project axially outward in opposite directions from the vane root 11.

In the mounted state, the inlet flange 12 engages into the inlet groove 9, while the outlet flange 13 engages into the outlet groove 10. Engagement in this case takes place axially in each case, with the result that a form fit between vane root 11 and vane carrier 4 is formed in the radial direction.

The vane root 11 and therefore also its flanges 12 and 13 possess a front end portion 14 in the circumferential direction 3 and, spaced apart from this, a rear end portion 15 in the circumferential direction 3. Between the end portions 14 and 15 is formed a middle portion 16 which has, preferably in the circumferential direction 3, approximately the same length as the two end portions 14 and 15 together. The middle portion 16 may likewise be longer in the circumferential direction 3 than the two end portions 14, 15 together.

Figure 3A:
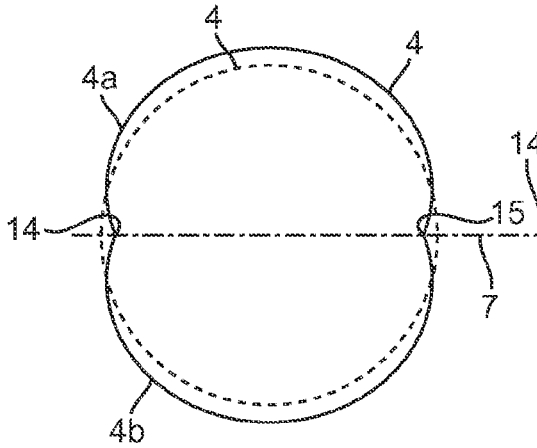
FIGS. 3*a* and 3*b* show simplified illustrations, as in FIG. 1, but in different deformation states.
Figure 3B:
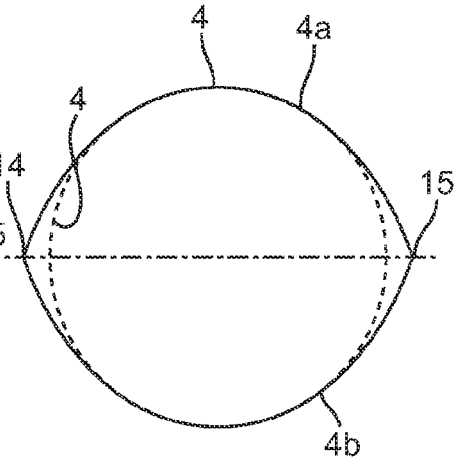

According to FIGS. 3*a* and 3*b*, when the turbomachine is in operation, deformations of the vane carrier 4 may occur due to thermal loads, particularly in transient operating states. In this case, in FIGS. 3*a* and 3*b*, the original circular shape of the vane carrier 4 is reproduced by a broken line, while the respective deformation shape is reproduced by an unbroken line.

The two vane carrier parts 4*a* and 4*b* butt against one another in the circumferential direction at circumferential ends 14 and 15. Due to the thermal load on the vane carrier 4, ovalization occurs, which is indicated, greatly exaggerated, in FIGS. 3*a* and 3*b*. On the one hand, in the case of such ovalization, according to FIG. 3*a*, a kind of contraction may be formed in the region of the parting plane 7, which arises due to the fact that the circumferential ends 14 and 15 bearing against one another move toward one another along the parting plane 7, this being accompanied by a reduction in the flexion radius of the vane carrier parts 4*a* and 4*b*. On the other hand, according to FIG. 3*b,* the ovalization may also have the result that the circumferential ends 14 and 15 butting against one another move away from one another along the parting plane 7. This is equivalent to an increase in the flexion radius of the vane carrier parts 4*a,* 4*b.* This ovalization at the same time leads to a distortion of the vane carrier 4. Furthermore, as a rule, the deformation of the lower vane carrier part 4*b* is markedly greater than the deformation of the upper vane carrier part 4*a,* since the upper vane carrier part 4*a* is regularly connected more firmly to the casing 5, thus leading to a stiffening of the upper vane carrier part 4*a.*

Figure 4A:
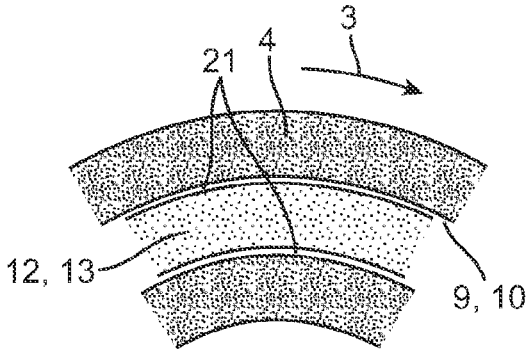
FIGS. 4*a*-4*c* show enlarged sectional illustrations in the region of a groove of a vane carrier with, engaging therein, a flange of a vane root, in different deformation states of the vane carrier.
Figure 4B:
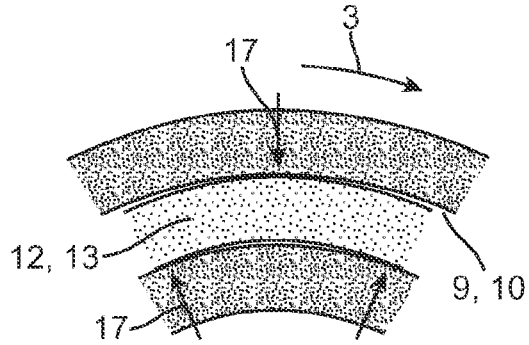
Figure 4C:
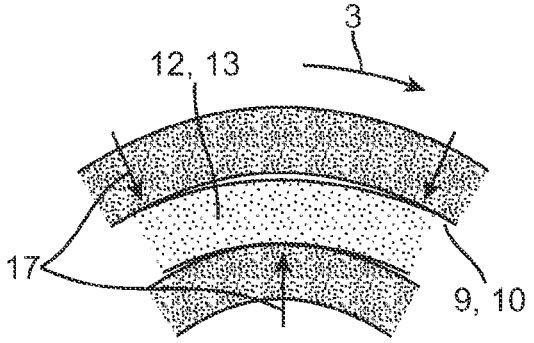

FIGS. 4*a* to 4*c* show enlarged sectional views through one of the grooves 9 or 10 into which one of the flanges 12 or 13 engages. In this case, the curvature occurring in the circumferential direction 3 is illustrated, greatly exaggerated. It can be seen that, in an undeformed initial position according to FIG. 4*a,* the groove 9, 10 possesses the same curvature of the flange 12, 13, so that uniform contacting with the vane carrier 4 takes place along the flange 12, 13. The uniform contacting is represented here, for greater clarity, by a clearance 21 which is ideally the same size radially on the outside and radially on the inside.

In the event of ovalization according to FIG. 3*b,* deformation according to FIG. 4*b* occurs in the region of the groove 9, 10 and has the result that the respective flange 12, 13 is subjected to extremely high compressive load radially on the inside in the region of its end portions 14, 15 and radially on the outside in the region of its middle portion 16, this being indicated by corresponding arrows 17. The abovementioned clearance 21 disappears in these regions.

In the event of ovalization according to FIG. 3*a,* the deformation state reproduced in FIG. 4*c* occurs, in which the respective flange 12, 13 is exposed to extreme compressive loads, again indicated by arrows 17, radially on the inside in the region of its middle portion 16 and radially on the outside in the region of its end portions 14, 15. In this case, too, the abovementioned clearance 21 disappears. It is clear, in this case, that such a clearance 21 does not have to be present in the actual installation state, but serves here merely for explaining the deformations and loads which arise.

In FIG. 5, the vane carrier 4 is reproduced once by an unbroken line in a deformed state usually occurring during operation and by a broken line in an undeformed initial state which arises when the turbomachine is cold.

Figure 6:
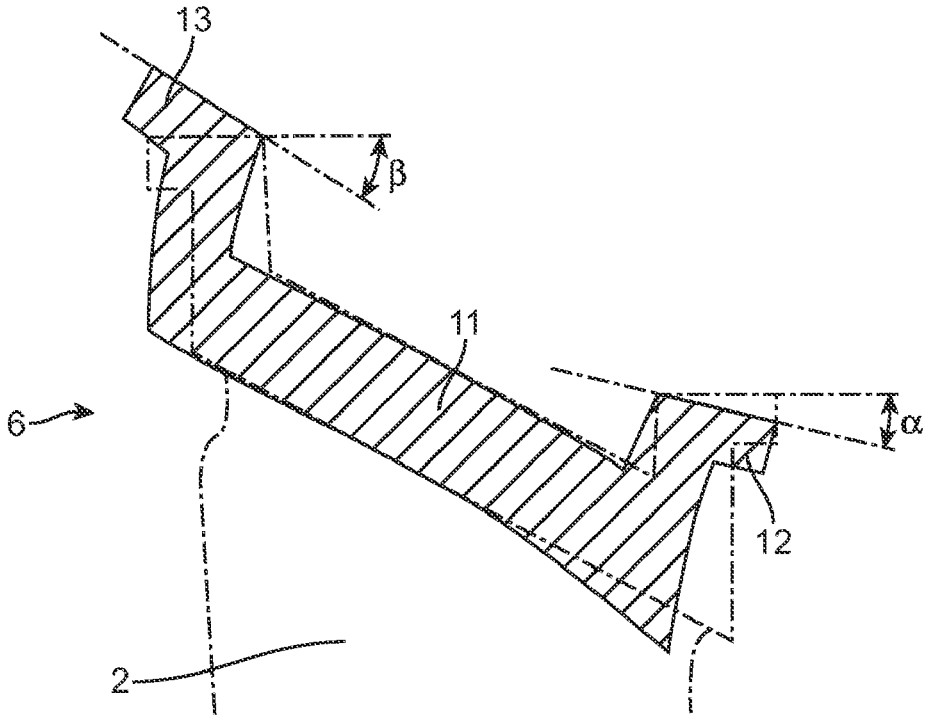
FIG. 6 shows an axial section through a vane root in different deformation states.

FIG. 6 shows an axial section through the root 11 of a vane 2 or of a vane group 6, two different operating states also being reproduced here. The section in the normal operating state, that is to say when the turbomachine is hot, is hatched. In contrast to this, an undeformed initial state which arises when the turbomachine is cold is reproduced without hatching. It can be seen that the inflow-side inlet flange 12 can tilt at an angle $\alpha$, while the outflow-side outlet flange 13 can tilt at an angle $\beta$. A further difficulty is that the two angles $\alpha$ and $\beta$ may be of different size. In FIG. 6, the deformations are again reproduced with exaggerated clarity and, in particular, are not to be taken as being true to scale.

Figure 7:
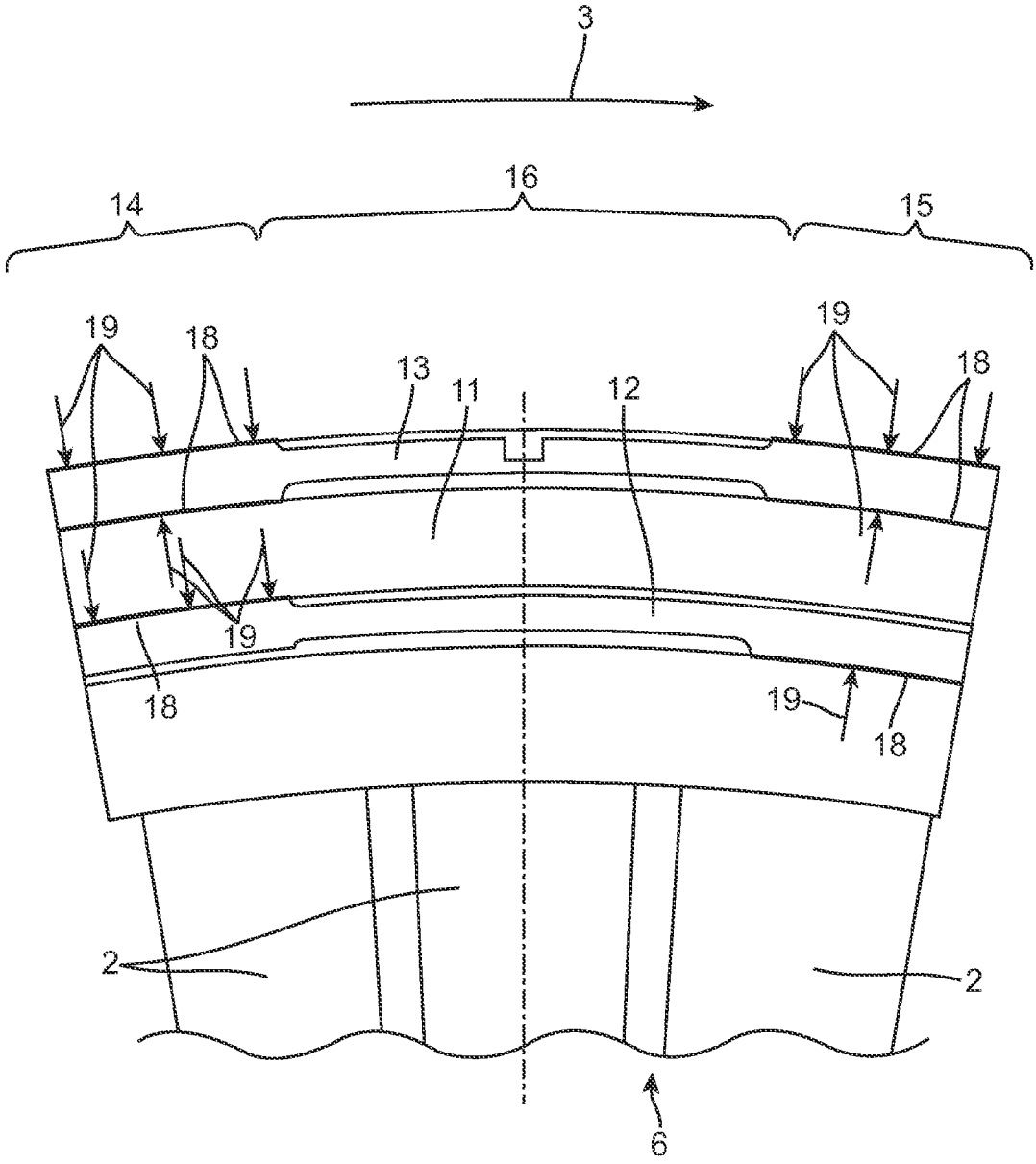
FIG. 7 shows a simplified axial view of a vane root according to the invention.

FIG. 7, then, shows an inflow-side axial view of the vane root 11 of the vane group 6. The inlet flange 12 facing the observer is in this case arranged further downward, that is to say further inward radially, than the outlet flange 13 which faces away from the observer and is per se concealed and which is arranged further upward, that is to say further outward radially. The arrangement of the flanges 12, 13 means that this must be a vane group 6 of a turbine.

Figure 8:
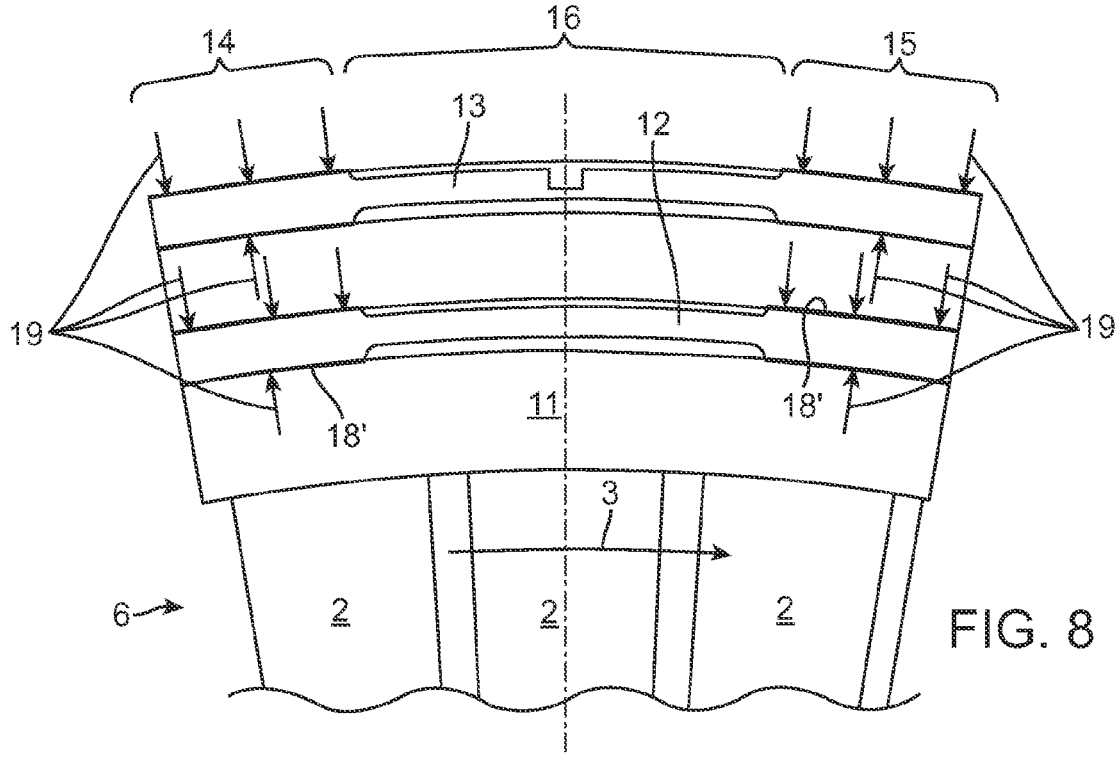
FIG. 8 shows a view, as in FIG. 7, but in the case of a vane root of a guide vane ring before its modification.
Figure 9:
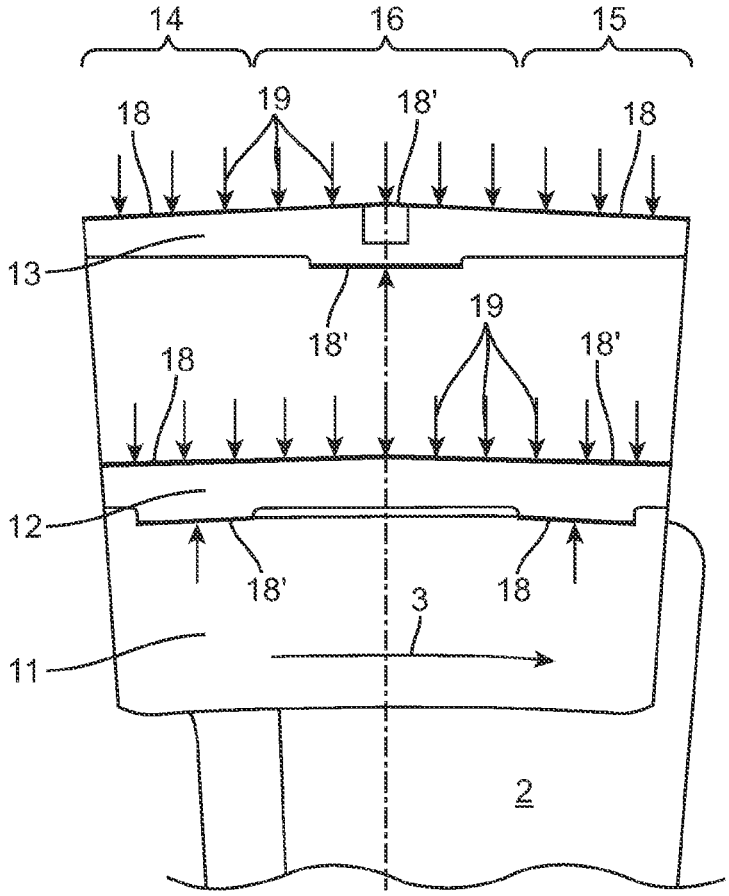
FIG. 9 shows a view, as in FIG. 8, but in another embodiment of the vane root.

It is essential to the invention, then, that the flanges 12 and 13 are machined on their radial sides in such a way that they contact the vane carrier 4 in the associated grooves 9, 10 in selected contact zones which are explained in more detail below. The contact zones are indicated in FIGS. 7 to 9 by a greater line thickness and are designated by 18. Furthermore, arrows 19 indicate where, in the installation state, a transmission of force takes place between the vane root 11 and the vane carrier 4.

According to the invention, the contact zones 18 are distributed as follows:

One of the flanges 12, 13, here the outflow-side outlet flange 13, is equipped both on its front end portion 14 and on its rear end portion 15, both radially on the inside and radially on the outside, in each case with a contact zone 18 of this type, said contact zones bearing radially against the vane carrier 4, that is to say within the outlet groove 10, in the installation state. A type of 4-point mounting is thus obtained for the outlet flange 13. In contrast to this, here, the inlet flange 12 is provided only on one end portion, here on the front end portion 14, radially on the outside, with such a contact zone 18 which bears against the vane carrier 4 in the installation state, whereas said inlet flange is shaped radially on the inside in such a way that the end portion 14 is spaced apart from the vane carrier 4 in the installation state. Furthermore, the inlet flange 12 is equipped on its other end portion, that is to say, here, on the rear end portion 15, radially on the inside, with a contact zone 18 of this type which bears against the vane carrier 4 in the installation state, while said inlet flange is shaped radially on the outside in such a way that the rear end portion 15 is spaced apart from the vane carrier 4 in the installation state. This results to that extent in a type of 2-point mounting for the inlet flange 12. In this case, the two contact zones 18 and, correspondingly, the two spacing zones, not designated in any more detail, are arranged on the inlet flange 12 diametrically opposite one another with respect to the end portions 14 and 15.

By virtue of this type of construction proposed according to the invention, the tie-up of the vane root 11 to the vane carrier 4 acquires defined degrees of freedom which, in the event of the typical deformations of the vane carrier 4 which, thermally induced, are experienced by the latter in transient operating states, bring about a reduction in the transmission of force between the vane carrier 4 and vane root 11. Thus, the vane roots 11 and therefore the vanes 2 or vane groups 6 are subjected to less load due to the deformations of the vane carrier 4.

As already explained further above, it is in this case advantageous if the end portions 14 and 15 and therefore the contact zones 18 formed on them are spaced relatively far apart from one another in the circumferential direction 3. Correspondingly, the middle portion 16 has comparatively large dimensioning in the circumferential direction 3, in particular is the same size as or is larger than the two end portions 14, 15, together.

Moreover, the contact zones 18 may be manufactured in a controlled way such as to produce linear bearing against or contacting on the vane carrier 4, which bearing or contacting may be oriented, for example, radially or in the circumferential direction. The contact zones 18 may likewise also be configured such as to produce punctiform contactings with the vane carrier 4.

An embodiment is particularly advantageous which, for the tie-up of the vane roots 11 to the vane carrier 4, provides the desired degrees of freedom essentially only when the vane carrier 4 is deformed, for example due to transient operating states of the turbomachine, whereas said additional degrees of freedom may be dispensed with in favor of increased support when the turbomachine is in nominal or normal operation. Expediently, therefore, the spacings with respect to the vane carrier 4 in the case of the inlet flange 12 in the region of the end portions 14 and 15 may be dimensioned such that a pressure difference between the inflow side and the outflow side of the respective guide vane ring 1, said pressure difference occurring during the normal operation of the turbomachine, brings about an elastic flexural deformation of the vanes 2 or vane group 6 and/or of the vane carrier 4, which reduces said spacings, specifically preferably to an extent such that the corresponding end portions 14 and 15 then likewise come to bear against the vane carrier 4. In the load state, said additional degrees of freedom are then canceled. In transient states, said pressure difference falls, with the result that the end portions 14 and 15 lift off from the vane carrier 4 again, in order to restore the degrees of freedom which reduce the stresses in the vane root 11 during the deformations of the vane carrier 4.

Although, in the present example, the inlet flange 12 is equipped with two contact zones 18 and the outlet flange 13 with four contact zones 18, the distribution of the contact zones 18 may also be reversed. The distribution of the contact zones 18 at the two end portions 14, 15 in the case of the flange 12 equipped with only two contact zones 18 may likewise be reversed with respect to the arrangement on the inside and on the outside.

According to FIG. 2, the vanes 2 may be connected to one another radially on the inside via shrouds 20 and, in the mounted state, be supported against one another in the circumferential direction.

A method according to the invention for the modification of a conventional guide vane ring is explained in more detail below:

First, the vanes 2 or vane groups 6 are demounted from the vane carrier 4. The demounted vane groups 6 may be designed in the region of the vane root 11, for example, as in FIG. 8. This means that both the inlet flange 12 and the outlet flange 13 are equipped both on the front end portion 14 and on the rear end portion 15, both radially on the inside and radially on the outside, in each case with a contact zone 18 and 18'. A demounted vane 2 may be designed, for example, in the region of its vane root 11, in the same way as FIG. 9, and correspondingly have a particular distribution of contact zones 18 and 18'.

In a further method step, then, the flanges 12 and 13 of the vane roots 11 are machined on the demounted vanes 2 or on the demounted vane groups 6.

In the case of a vane group 6 according to FIG. 8, the radially inner contact zone 18' is removed, for example by means of a milling cutter or the like, on the inlet flange 12 at its front end portion 14. The radially outer contact zone 18' is likewise removed on the inlet flange 12 at its rear end portion 15. As a result, the machined vane root 11 then possesses, in the region of its flanges 12, 13, the same configuration as for the vane root 11 according to FIG. 7 designed according to the invention.

In the case of the vane root 11 according to FIG. 9, the two radially outer sides of the flanges 12 and 13 are designed in each case as continuous contact zones 18'. Furthermore, the outlet flange 13 possesses, radially on the inside, only one single contact zone 18' which, moreover, is arranged in the middle portion 16. The machining of this vane root 11 in this case takes place such that the middle portion 16 is stripped away on the outlet flange 13 on the radially outer side, to an extent such that in each case one of the desired contact zones 18 remains only in the end portions 14 and 15. Furthermore, the contact zone 18' in the middle portion 16 is removed on the radially inner side by the corresponding stripping away of material. Moreover, by a suitable build-up of material, for example by welding or soldering, in each case the desired inner contact zone 18 is provided radially on the inside at the end portions 14 and 15, in order, here too, to obtain a corresponding shaping, such as is reproduced in FIG. 7.

The inlet flange 12 is machined, here, in such a way that the radially inner contact zone 18' provided in the front end portion 14 is removed completely. Furthermore, the continuous contact zone 18' present radially on the outside is stripped away radially on the outside in the region of the middle portion 16 and in the region of the rear end portion 15 until the configuration reproduced in FIG. 7 is obtained. Thus, even in the vane root type reproduced in FIG. 9, the contour according to the invention, reproduced in FIG. 7, can be produced.

Overall, therefore, the method shown here is suitable particularly for converting a conventional guide vane ring into the guide vane ring 1 according to the invention, the vanes 2 of which can better absorb the deformations of the vane carrier 4.

| List of reference symbols | |
|---|---|
| 1 | Guide vane ring |
| 2 | Vane |
| 3 | Circumferential direction |
| 4 | Vane carrier |
| 4a | Upper vane carrier part |
| 4b | Lower vane carrier part |
| 5 | Casing |
| 6 | Vane group |
| 7 | Parting plane |
| 8 | Longitudinal center axis/axis of rotation |
| 9 | Inlet groove |
| 10 | Outlet groove |
| 11 | Vane root |
| 12 | Inlet flange |
| 13 | Outlet flange |
| 14 | Front end portion |
| 15 | Rear end portion |
| 16 | Middle portion |
| 17 | Compressive load |
| 18 | Contact zone |
| 19 | Compressive load |
| 20 | Shroud |
| 21 | Clearance |

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

The invention claimed is:

1. A guide vane ring useful in a turbomachine having a casing, the vane ring comprising:

an annular vane carrier having an inflow-side inlet groove and an outflow-side outlet groove, the vane carrier configured and arranged to be fastened to the casing of the turbomachine;

a plurality of vanes on the annular vane carrier;

the inlet and outlet grooves extending in the circumferential direction;

each of the plurality of vanes having a vane root which has an inflow-side inlet flange and an outflow-side outlet flange;

the inlet and outlet flanges each extending in the circumferential direction and projecting axially from the respective vane root;

each vane root inlet flange engaging into the vane carrier inlet groove and each vane root outlet flange engaging into the vane carrier outlet groove;

one of the inlet and outlet flanges having, both on a front end portion in the circumferential direction and in a rear end portion in the circumferential direction, both radially on the inside and radially on the outside, a contact zone which bears against the vane carrier;

the other of the inlet and outlet flanges having, on one end portion, radially on the inside, a contact zone which bears against the vane carrier and which is spaced apart from the vane carrier radially on the outside, and having on the other end portion, radially on the outside, a contact zone which bears against the vane carrier and which is spaced apart from the vane carrier radially on the inside;

the inlet and outlet flanges, between their end portions, being spaced apart from the vane carrier both radially on the inside and radially on the outside.

2. The guide vane ring as claimed in claim 1, wherein the two end portions of each flange are in the circumferential direction approximately the same size as or smaller than a middle portion arranged between the end portions.

3. The guide vane ring as claimed in claim 1:

wherein the vanes are connected to one another; or further comprising shrouds, the vanes supported against one another radially on the inside via the shrouds; or both.

4. The guide vane ring as claimed in claim 1, wherein the contact zones are configured to form linear or punctiform bearing contact against the vane carrier.

5. The guide vane ring as claimed in claim 1 4, wherein the spacing of said other flange at the end portions thereof from the vane carrier is dimensioned such that, during the normal operation of the turbomachine, a pressure difference prevailing between the inflow side and the outflow side reduces the spacing owing to the elastic flexural deformation of the vane, of the vane carrier, or of both, and brings the corresponding end portion to bear against the vane carrier.

6. A system comprising:

a turbomachine comprising an axial-throughflow turbine or a compressor, and having a casing; and a guide vane ring as claimed in claim 1, fastened to said casing.

7. The system as claimed in claim 6, wherein the turbomachine comprises a gas turbine.

8. A method for the modification of a guide vane ring of a turbomachine, the method comprising:

demounting vanes, vane groups comprising a plurality of vanes, or both, from an annular vane carrier;

machining flanges of vane roots of the demounted vanes, of the demounted vane groups, or of both;

installing the machined vanes, machined vane groups, or both, in the vane carrier again;

wherein said machining is performed so that, after said installing, a guide vane ring as claimed in claim 1 is formed.

9. The method as claimed in claim 8, wherein the turbomachine comprises an axial-throughflow turbine or a compressor.

10. The method as claimed in claim 8, wherein the turbomachine comprises a gas turbine.

* * * * *